US010765223B2

(12) United States Patent
Marino

(10) Patent No.: US 10,765,223 B2
(45) Date of Patent: Sep. 8, 2020

(54) MULTI-PURPOSE PORTABLE MATTRESS EXTENDER

(71) Applicant: David Michael Marino, Atlanta, GA (US)

(72) Inventor: David Michael Marino, Atlanta, GA (US)

( * ) Notice: Subject to any disclaimer, the term of this patent is extended or adjusted under 35 U.S.C. 154(b) by 78 days.

(21) Appl. No.: 16/178,359

(22) Filed: Nov. 1, 2018

(65) Prior Publication Data

US 2019/0069684 A1 Mar. 7, 2019

Related U.S. Application Data

(60) Provisional application No. 62/592,528, filed on Nov. 30, 2017.

(51) Int. Cl.
*A47C 19/04* (2006.01)
*A47C 21/00* (2006.01)

(52) U.S. Cl.
CPC ..... *A47C 19/04* (2013.01); *A47C 21/00* (2013.01)

(58) Field of Classification Search
CPC ..... A47C 19/04; A47C 21/00–21/08; A47D 7/00
See application file for complete search history.

(56) References Cited

U.S. PATENT DOCUMENTS 3,688,321 A * 9/1972 Moss ..... A47C 19/04 5/661
6,047,422 A * 4/2000 Yousif ..... A47C 19/04 5/184
9,924,805 B2 * 3/2018 Cass ..... A47C 21/00
2004/0261175 A1 * 12/2004 May ..... A47C 7/62 5/503.1

OTHER PUBLICATIONS

Jeri Dansky. "No Nightstand? 9 Products for Bedside Organization." Available at https://www.core77.com/posts/55275/No-Nightstand-9-Products-for-Bedside-Organization#. Aug. 4, 2016 (Year: 2016).*

* cited by examiner

*Primary Examiner* — Kristen Matter

(57) ABSTRACT

The present invention comprises a novel mattress extension device that can be fixed or that is adjustable for depth and height, which is portable, and capable of conforming the device to the contours of any given mattress and box spring. In preferred embodiments, the various elements of the mattress extender device are each configured to meet the specifications of any or all applications.

3 Claims, 2 Drawing Sheets

MULTI-PURPOSE PORTABLE MATTRESS EXTENDER

FIELD OF THE INVENTION

The present invention relates to extending the usefulness of a bed's area. More particularly, the invention relates to a fixed or adjustable placement device that is capable of being positioned anywhere along a mattress to be an extension of it.

BACKGROUND

It has always been a problem for people who sleep on their sides or with other people or pets, to have enough space without their extremities hanging over the existing bed. Waking up in pain or discomfort is a daily routine for many people. There has always been a need for more space.

There is also at least one secondary need. Storage space. End tables can be costly and/or take up a lot of space.

Certain extenders have been developed for the mattress extensions along various surfaces. The devices are usually made of foam and are placed between the mattress and side rail or foot board to help reduce dangerous gaps between a larger box spring and a smaller mattress.

However, these extenders are made to close gaps in mattresses that do not extend all the way to the side of the bed, not for comfort or storage.

Therefore, a need exists in the field for a novel mattress extension device and/or apparatus capable of extending a mattress in any direction along the perimeter of a bed for uses such as, but not excluding mattress extension and/or storage capabilities.

A further need exists for a mattress extension device that is able to accommodate mattresses of different widths and/or heights.

BRIEF SUMMARY OF THE INVENTION

The present invention provides relief for people whose body parts hang over the existing mattress by extending it out further from its source with a mattress pad or any like substance. In essence, turning a twin bed into a queen, a queen into a king, etc., for affected body parts. And in another embodiment of the present invention, a wood or composite replacement for the mattress pad provides a place for items like clocks, valuables and other unspecified items to be placed.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when use in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Multi-purpose portable mattress extension placement devices, apparatuses, and methods for positioning them along the perimeters of existing beds are discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention, and is not intended to limit the invention to the specific embodiments illustrated by the figures or description below.

Figure 1:
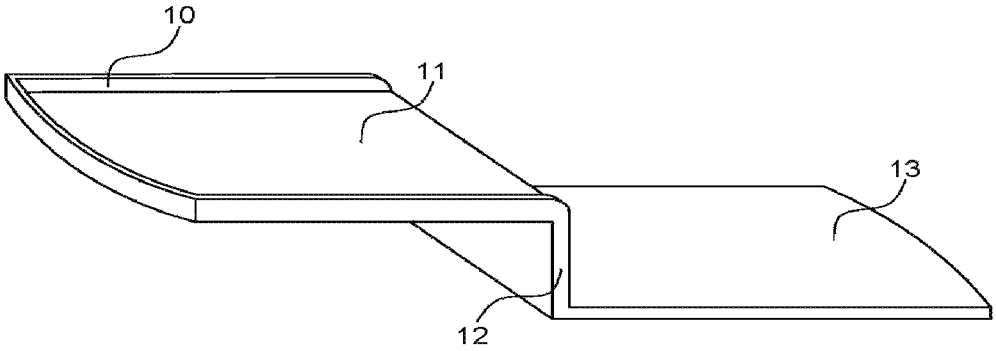
FIG. 1 depicts a view of one example of a height adjustable or non-adjustable mattress extension device that does not allow for the bed to be made while it is in place, according to various embodiments of the present invention.

The present invention will now be described by referencing the appended figures representing preferred embodiments. FIG. 1 depicts an exploded perspective view of the elements that may comprise a multi-purpose portable mattress extension device (the "device") according to various embodiments of the present invention. In preferred embodiments, each of the elements of the device are configured with at least one "lip" 10, which is part of, or connected to, the "tray" 11. The tray 11 is intended to be a resting place for a mattress pad or any like substance. And in another embodiment of the present invention, a wood or composite replacement for the mattress pad provides a place for items like clocks, valuables and other unspecified items to be placed. The tray 11 is part of, or connected to, an adjustable, or non-adjustable "arm" 12. The arm 12 is part of, or connected to, the "slab" 13. The slab 13 slides in between the mattress and box spring allowing the multiple components of the device (the "elements") to slide freely along the perimeter of the bed.

Figure 2:
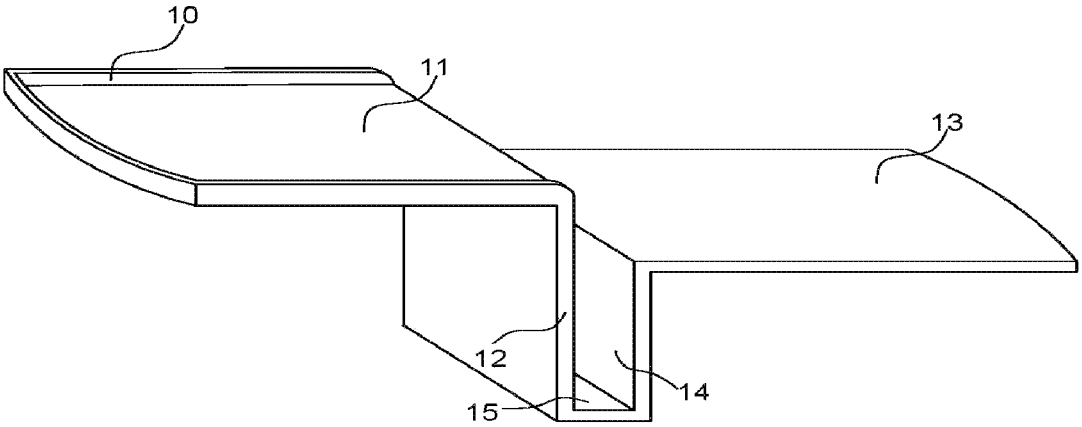
FIG. 2 illustrates an example of a height adjustable or non-adjustable mattress extension device that allows for the bed to be made while device is in place according to various embodiments described herein.

FIG. 2 depicts an exploded perspective view of the elements that may comprise a multi-purpose portable mattress extension device (the "device") according to various embodiments of the present invention. In preferred embodiments, each of the elements of the device are configured with at least one "lip" 10, which is part of, or connected to, the "tray" 11. The tray 11 is intended to be a resting place for a mattress pad or any like substance. And in another embodiment of the present invention, a wood or composite replacement for the mattress pad provides a place for items like clocks, valuables and other unspecified items to be placed. The tray 11 is part of, or connected to, an adjustable, or non-adjustable "arm" 12. The arm 12 is part of, or connected to, the "gutter" 15, which allows for a gap for the bed to be made while the device is in use. The gutter 15 is part of, or connected to, a "descending stabilizing arm" 14. The descending stabilizing arm is part of, or connected to, the "slab" 13. The slab 13 slides in between the mattress and box spring allowing the multiple components of the device (the "elements") to slide freely along the perimeter of the bed.

While preferred materials for elements have been described, the device is not limited by these materials. Wood, plastics, rubber, foam, metal alloys, aluminum, and other materials may comprise some or all of the elements of the mattress extending devices and apparatuses in various embodiments of the present invention.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A portable mattress extension device comprising:

a horizontal tray comprising a lip extending along a perimeter of the tray, the tray sized and configured to provide a resting place for a user's extremity during sleep;

a flat, horizontal slab configured to slide underneath a mattress and hold the device in place while the user's extremity is resting on the tray;

a gutter located between the tray and the slab, the gutter consisting of a vertical arm extending perpendicularly from an end of the tray, a horizontal portion creating a gap for receiving bed linen between the tray and the slab, and a vertical stabilizing arm extending perpendicularly from an end of the slab; and a pad located on top of the tray.

2. The portable mattress extension device of claim 1, wherein the arm is adjustable.

3. The portable mattress extension device of claim 1, wherein the arm has a length that is greater than a length of the stabilizing arm.

* * * * *